United States Patent [19]

Silver et al.

[11] Patent Number: 4,537,675

[45] Date of Patent: Aug. 27, 1985

[54] UPGRADED SOLVENTS IN COAL LIQUEFACTION PROCESSES

[75] Inventors: Howard F. Silver; Ronald L. Miller, both of Laramie, Wyo.

[73] Assignee: In-Situ, Inc., Laramie, Wyo.

[21] Appl. No.: 377,791

[22] Filed: May 13, 1982

[51] Int. Cl.[3] ..... C10G 1/00; C10G 1/06

[52] U.S. Cl. ..... 208/8 LE; 208/10

[58] Field of Search ..... 208/8 LE, 10, 14

[56] References Cited

U.S. PATENT DOCUMENTS

| | | | |
|---|---|---|---|
| 3,679,573 | 7/1972 | Johnson | 208/10 |
| 4,054,504 | 10/1977 | Chervenak et al. | 208/10 |
| 4,134,821 | 1/1979 | Gorin | 208/10 X |
| 4,159,236 | 6/1979 | Schmid | 208/10 |
| 4,159,237 | 6/1979 | Schmid | 208/10 |
| 4,159,238 | 6/1979 | Schmid | 208/10 |
| 4,189,371 | 2/1980 | Maa | 208/8 |
| 4,189,375 | 2/1980 | Kirby et al. | 208/8 |
| 4,203,823 | 5/1980 | Carr et al. | 208/10 |
| 4,221,631 | 9/1980 | Hellerqvist et al. | 162/23 |
| 4,222,847 | 9/1980 | Carr et al. | 208/8 |
| 4,222,848 | 9/1980 | Carr et al. | 208/8 |
| 4,227,991 | 10/1980 | Carr et al. | 208/8 |
| 4,230,556 | 10/1980 | Carr et al. | 208/8 |
| 4,255,248 | 3/1981 | Rosenthal et al. | 208/8 |
| 4,264,429 | 4/1981 | Rosenthal et al. | 208/10 |
| 4,264,430 | 4/1981 | Kuehler | 208/10 |
| 4,318,797 | 3/1982 | Jager et al. | 208/8 LE |
| 4,328,088 | 5/1982 | Anderson et al. | 208/10 X |
| 4,347,117 | 8/1982 | Bauman et al. | 208/8 LE |
| 4,356,077 | 10/1982 | Che | 208/8 LE |
| 4,369,106 | 1/1983 | Aldridge | 208/10 |
| 4,372,838 | 2/1983 | Kulik et al. | 208/10 |
| 4,374,015 | 2/1983 | Brulé208 | 8 LE/ |
| 4,452,688 | 6/1984 | Mitchell et al. | 208/10 |

FOREIGN PATENT DOCUMENTS 2756976 12/1977 Fed. Rep. of Germany .

OTHER PUBLICATIONS

M. S. Thesis, "Solvent Effects on Non-Catalytic Wyodak Coal Hydroliquefaction," Miller, Ronald L., May 1979.

DOE Report, "The Effect of Solvent Characteristics on Coal Liquefaction" Silver and Hurtubise, Jul. 15, 1980.

DOE Report, "EDS Coal Liquefaction Process Development," Phases IV-V, Exxon, Mar. 1981.

*Primary Examiner*—D. E. Gantz

*Assistant Examiner*—William G. Wright

*Attorney, Agent, or Firm*—Sheridan, Ross & McIntosh

[57] ABSTRACT

New solvent compositions and a new two-stage direct coal liquefaction process are provided which permit control of the liquid product state from one consisting primarily of low boiling distillate to one consisting primarily of high boiling fuel oil. The use of the new solvent composition in the process significantly increases distillable liquid yields from coal or lignites. The preferred solvent contains from about 0 to 100 weight percent of pyridine-soluble bottoms, i.e., mineral matter-free normally solid dissolved coal, in which the hydrogen content is maintained at an optimum level by adding from about 0.05 to about 2.0 weight percent hydrogen in a hydrotreating step and from about 0 to 100 weight percent of a coal-derived distillate boiling below about 800° F. to about 1000° F.

15 Claims, 1 Drawing Figure

UPGRADED SOLVENTS IN COAL LIQUEFACTION PROCESSES

BACKGROUND a. Field of Invention

This invention relates to coal liquefaction processes and, in particular, to the use of coal-derived liquids to liquefy coal.

The U.S. Government has retained at least an irrevocable, non-exclusive, paid-up license to make, use and sell the above-identified invention throughout the world by or on behalf of the U.S. Government (including any Government agency) under the provisions of 41 CFR 9-9.109-6.

b. Brief Description of the Prior Art

Because of the decreasing supply and rising price of petroleum, efforts to produce liquid fuels from solid organic materials such as coal have intensified in recent years. Further, environmental concerns have created demand for fuels with a low content of sulfur and nitrogen.

Many direct coal liquefaction processes have been developed. These processes transfer hydrogen to the coal via distillable hydrogen donor or hydrogen shuttler solvents in a coal liquefaction reactor or dissolver. State-of-the-art technology allows production of distillable coal-derived solvents in one of the following ways:

1. thermal hydrogenation of the distillable solvent-coal slurry mixture at elevated temperature and pressure,
2. catalytic hydrogenation of the distillable solvent-coal slurry at elevated temperature and pressure, or
3. catalytic hydrogenation of the distillable solvent followed by thermal hydrogenation of distillable solvent-coal slurry mixture.

Distillable solvents produced by any of these methods are recycled to the inlet of the dissolver where they are mixed with fresh coal. Coal liquefaction processes using distillable solvents frequently produce large quantities of nondistillable liquids undesirable for use as liquid fuels.

In an effort to reduce the yields of nondistillable liquids from coal, many processes have evolved in which certain portions of the product stream from the dissolver are recycled for use as all or part of the solvent in the solvent-coal slurry. Heretofore it has been thought that the distillable fraction of the recycle stream was desirable and functional for solvent purposes. Accordingly, it was known to subject the distillate fraction of the recycle stream to hydrogenating and/or hydrocracking to enhance its hydrogen content prior to use as the solvent. U.S. Pat. Nos. 4,255,248, 4,264,429, 4,264,430 and 4,300,996 are representative of the state-of-the-art in treating recycle solvent streams. Each of these patents, however, teach the effect of hydrotreating the normally liquid, low molecular weight heptane-soluble fraction of the dissolver effluent prior to use as the recycle solvent.

Others have recognized the importance of recycling a solvent slurry consisting of nondistillable, normally solid dissolved coal and mineral residue. U.S. Pat. Nos. 4,230,556, 4,227,991, 4,222,848, 4,222,847, 4,211,631, 4,203,823, 4,189,375, 4,159,238, 4,159,237 and 4,159,236 are representative of this technology. Each of these patents emphasizes the catalytic effects of the mineral residue in the recycle slurry. However, these patents do not mention solvent upgrading. Heretofore the importance of upgrading high molecular weight, normally solid dissolved coal that is essentially mineral residue free in a hydrotreater prior to use as a recycle solvent has gone unrecognized. Normally solid essentially mineral residue free dissolved coal is substantially pyridine (m-cresol, tetrahydrofuran) soluble vacuum still bottoms which boil above about 800° F. to about 1000° F. and will hereinafter be referred to as "bottoms".

According to the present invention it is possible to maximize or minimize production of light liquid products from coal. Higher yields of liquid products boiling in the range of about $C_4$–800° F. are obtained from this process than from other state-of-the-art methods of direct coal liquefaction. The present invention is based upon the recognition of the importance of the bottoms, defined above, to which limited amounts of hydrogen have been added by mild hydrotreatment, in the solvent recycle stream.

SUMMARY OF THE INVENTION

New solvent compositions and a new two-stage direct coal liquefaction process are provided which permit control of the liquid product slate from one consisting primarily of low boiling distillate to one consisting primarily of high boiling fuel oil or residue. The use of the new solvent composition in the process significantly increases distillable liquid yields from coal or lignites. The preferred solvent contains from about 0 to 100 weight percent of bottoms in which the hydrogen content is maintained at an optimum level by adding from about 0.05 to about 2.0 weight percent hydrogen in a mild hydrotreating step and from about 0 to 100 weight percent of a coal-derived distillate boiling below about 800° F. to about 1000° F.

Bottoms for purposes of the present invention must contain asphaltenes and preasphaltenes. Such bottoms may also contain oils, unreacted coal and mineral matter. Asphaltenes are operationally defined as that portion of the normally solid dissolved coal, which is soluble in benzene or toluene but insoluble in cyclohexane, pentane, hexane or heptane. Preasphaltenes are operationally defined as that portion of normally solid dissolved coal which is soluble in pyridine, m-cresol or tetrahydrofuran but insoluble in benzene or toluene. Oils are operationally defined as that portion of the normally solid dissolved coal which is soluble in cyclohexane, pentane, hexane or heptane. Insoluble organic matter or unreacted coal and mineral matter are operationally defined as that portion of the normally solid dissolved coal which is insoluble in pyridine, m-cresol or tetrahydrofuran. The hydrotreated bottoms contain less than about 50 weight percent, preferably less than about 30 weight percent benzene-insolubles, the remainder comprising benzene-solubles. Solvent blends of distillates and upgraded bottoms should contain no more than about 40 percent pyridine-insoluble materials.

Liquefaction of the coal or lignite is carried out independently from solvent upgrading. Noncatalytic coal or lignite dissolution is carried out at high temperatures and pressures in a dissolver. The composition of the bottoms fraction of the solvent used to dissolve the coal or lignite is optimized in a separate catalytic hydrotreater operated under reaction conditions selected to optimize bottoms hydrogen content.

DESCRIPTION OF ONE EMBODIMENT

Figure 1:
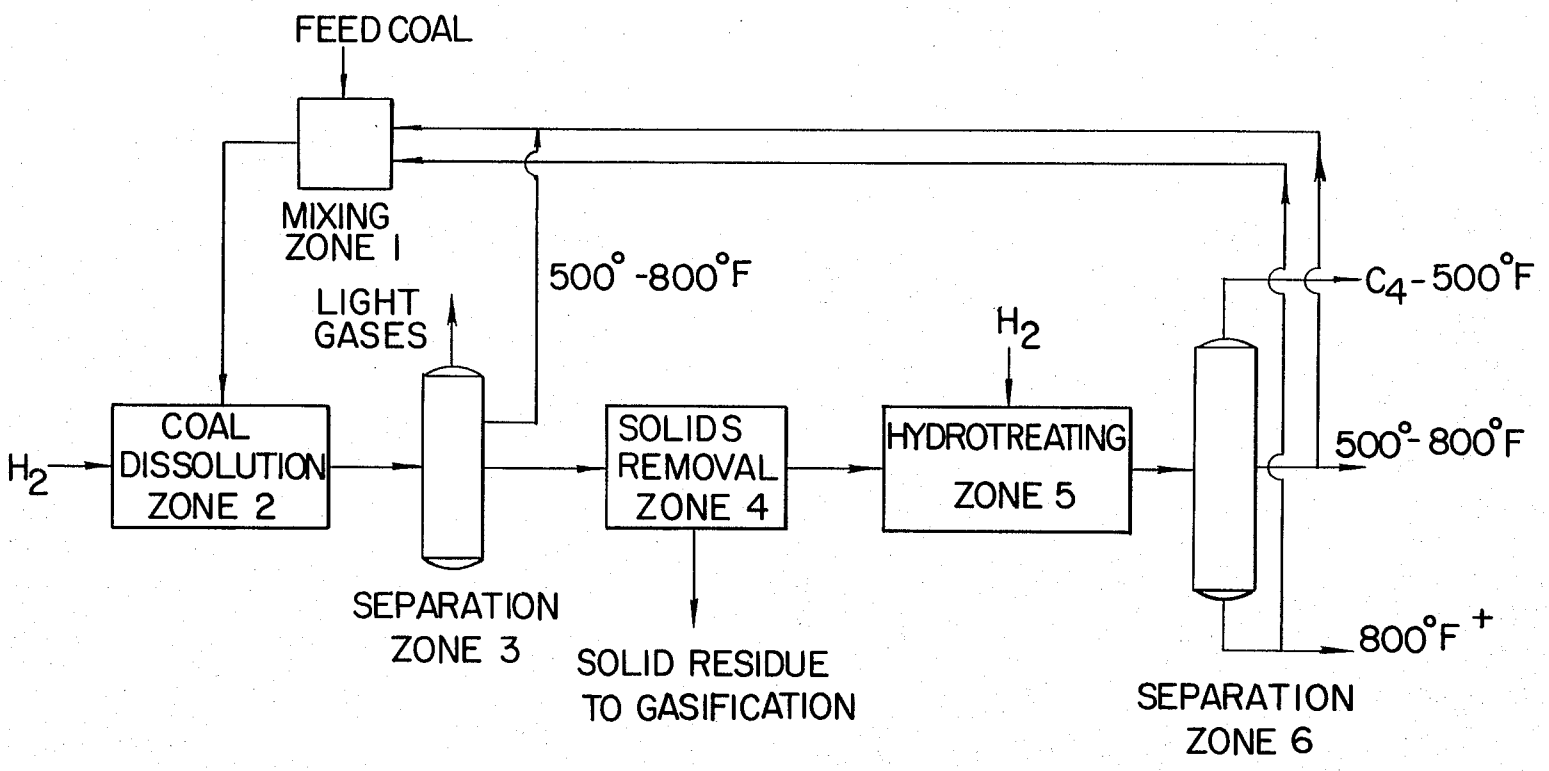
FIG. 1 is a flowsheet diagram depicting one process according to the present invention.

A detailed description of a coal liquefaction process according to this invention is described below with reference to FIG. 1.

Finely ground coal is charged to mixing zone 1 together with a hydrogen donor solvent consisting of coal-derived liquid produced in the process. Solvent to coal weight ratio of the slurry leaving mixing zone 1 can vary from about 1:10 to 10:1 with an optimum ratio near about 2:1. The coal slurry is pumped into coal dissolution zone 2 where it is heated in the presence of molecular hydrogen to a temperature between about 800° F. and 900° F., preferably about 825° F., for about five minutes to about 180 minutes, preferably about 40 to about 80 minutes, until a large percentage of the coal is dissolved. Preferably, between about 80–95 weight percent of the coal, as calculated on a moisture and mineral matter-free basis, is dissolved in coal dissolution zone 2. Other reaction conditions in this zone include a slurry residence time of from about 0.1 to about 3.0 hours, preferably about 0.5 to about 1.5 hours, hydrogen partial pressures in the range of about 1000 to about 5000 psi, preferably about 1500 to about 2500 psi, and hydrogen gas flow rates between about 10,000 SCF/ton of coal and about 200,000 SCF/ton of coal, preferably about 80,000 SCF/ton to about 120,000 SCF/ton of coal. The coal dissolution zone need not, and preferably does not, contain any catalyst.

Total effluent from coal dissolution zone 2 is sent to separation zone 3 where light gaseous products and lower boiling liquid products are removed from the slurry of liquid products and insoluble solid material. The light gases contain a large quantity of unreacted hydrogen which is recovered for use elsewhere in the process. A portion of the dissolver distillate may be recycled back to mixing zone 1. That portion of the liquid slurry from separation zone 3 which is not recycled is sent directly to solids removal zone 4, where unreacted coal and mineral matter are removed from liquid products using filtration, settling, centrifugation, or solvent extraction. The solids obtained in this separation may be gasified using available commercial technology to provide additional hydrogen for the process. The liquids emanating from solids removal zone 4 will be substantially free of unreacted coal and mineral matter, i.e., the solids will be removed to the maximum extent possible in conventional solids removal process units, typically below 10 weight percent, and more typically below 5 weight percent.

Solids-free products from solids removal zone 4 are catalytically hydrogenated in hydrotreating zone 5 over a hydrocracking catalyst. Hydrotreating reaction conditions in this zone are temperatures in the range of about 600° F. to about 800° F., preferably about 650° F. to about 750° F., hydrogen partial pressures between about 1000 and 4000 psi, preferably about 1500 to about 2500 psi, residence times between about 0.1 and about 3.0 hours, preferably about 0.5 and about 1.5 hours, and hydrogen flow rates between about 2000 and about 40,000 SCF/bbl, preferably about 15,000 to about 25,000 SCF/bbl. The preferred operating conditions are those sufficient to add from about 0.05 to about 2.0 percent by weight hydrogen to the bottoms. Depending upon the type of hydrotreater used in hydrotreater zone 5, solids removal zone 4 can be placed either before or after hydrotreating zone 5 in the process scheme.

The entire hydrogenated product is fractionated in separation zone 6. Portions of hydrogenated distillate and bottoms liquids necessary to keep the process in solvent balance are recycled to mixing zone 1 to be slurried with additional feed coal. Weight ratio of distillable product to bottoms in the recycle solvent typically varies between about 1:10 to 10:1, depending on the desired product slate. As will be understood by those in the art, although impractical from a commercial process point of view, the process of the present invention could utilize solvents containing no distillate or all distillate. Liquid and gaseous products can be withdrawn from either separation zone 3 or separation zone 6 or both.

By varying the ratio of distillate to bottoms in the solvent used to slurry coal fed to a noncatalytic coal liquefaction reactor, the slate of liquid products can be controlled from one consisting primarily of low boiling distillate to one consisting primarily of a high boiling fuel oil. The preferred solvent contains bottoms to which from about 0.05 to about 2.0 weight percent hydrogen, preferably about 0.1 to about 1.5 weight percent hydrogen, more preferably about 0.15 to about 1.0 weight percent hydrogen has been added in a catalytic hydrotreater. The actual amount of hydrogen to be added to the bottoms is that quantity which saturates some (one or two), but not all, of the aromatic rings and some of the heterocyclic molecules contained in the individual polyaromatic heterocyclic hydrocarbon compounds found in the bottoms. The total amount of hydrogen in the bottoms portion of the solvent which is optimum may vary to some extent depending upon the coal to be liquefied. For Wyodak coal the preferred solvent contains bottoms which after hydrotreating comprises from about 6.0 to about 7.0 weight percent hydrogen, more preferably from about 6.3 to about 6.5 weight percent hydrogen. For Kentucky 9/14 coal the preferred solvent contains bottoms which after hydrotreating comprise from about 5.0 to about 7.0 weight percent hydrogen, more preferably about 6.3 to about 6.5 weight percent hydrogen.

The desirable level of hydrogenation can most readily be obtained by mildly hydrotreating the bottoms for approximately one hour over a hydrocracking catalyst at temperatures between about 600° F. and about 800° F., preferably about 650° F. to about 750° F., or more preferably between about 680° F. and about 720° F., and hydrogen pressures between about 1000 to about 4000 psi, preferably about 1500 to about 3000 psi, more preferably between about 1800 to about 2500 psi or equivalent reaction conditions. At more severe hydrotreating conditions, it is possible to over-hydrogenate the bottoms, decreasing their effectiveness as a solvent. The hydrotreated bottoms should contain less than about 50 percent by weight and preferably less than about 30 percent by weight benzene (toluene)-insoluble material. That portion of the solvent which is not hydrotreated bottoms should consist primarily of distillate with the remainder, not to exceed about 40 percent by weight pyridine-insolubles, i.e., unreacted coal and mineral matter.

To maximize low boiling distillate yields, the preferred solvent contains about 20 to about 100 percent by weight hydrotreated bottoms, preferably about 30 to about 70 percent by weight hydrotreated bottoms and more preferably about 40 to about 60 percent by weight hydrotreated bottoms. The dissolver should be operated at maximum reaction severity.

To maximize high boiling fuel oil yields, the preferred solvent contains from about 0 to about 40 percent by weight hydrotreated bottoms, preferably from about 0 to about 20 percent by weight hydrotreated bottoms, more preferably from about 0 to about 10 percent by weight hydrotreated bottoms. The dissolver should be operated at the same or a less severe reaction severity than is used to produce maximum low boiling distillate yields.

The exact concentration of the desired hydrotreated bottoms in a recycle solvent can be controlled by independently optimizing reaction conditions in the dissolver and in the hydrotreater. The hydrotreater reactor should be operated in such a manner as to decrease the chemical association between polyaromatic, heterocyclic hydrocarbon molecules in the bottoms, to convert some (one or two), but not all, of the individual refractory aromatic rings in the polyaromatic heterocyclic hydrocarbons to reactive saturated hydrocarbons, and to minimize coking of the hydrotreating catalyst.

EXPERIMENTAL PROCEDURE

The following Examples are offered by way of illustration and not by way of limitation.

The following Examples refer to certain recycle solvents, i.e., coal-derived liquids. These following examples illustrate the advantages of this process over existing coal liquefaction processes in increasing liquid yields. Samples of subbituminous Wyodak coal, Wyodak coal-derived distillate and Wyodak coal-derived bottoms were supplied by Catalytic, Inc. from the Southern Services, Inc. SRC-I process pilot plant at Wilsonville, Ala. Samples of bituminous Kentucky 9/14 coal, Kentucky 9/14 coal-derived distillate and Kentucky 9/14 coal-derived bottoms were supplied by the Pittsburg & Midway Coal Mining Co. from their process pilot plant near Tacoma, Wash., operated in the SRC-I mode.

Portions of the bottoms were used as received while other portions were upgraded by hydrogenation. Other portions were mildly hydrogenated over a Co-Mo on $Al_2O_3$ catalyst (Nalcomo 477) for about 60 minutes at about 700° F. in a two-liter Autoclave Magnedrive II batch reactor. Initial cold reactor hydrogen pressure for these runs was 2000 psi. Still other portions were severely hydrogenated over a catalyst at about 800° F. for 60 minutes in the batch reactor using an initial cold reactor hydrogen pressure of 3000 psi.

Coal liquefaction experiments were then conducted by charging the batch reactor with distillate and bottoms in a 1:1 weight ratio and distillate to bottoms to coal in a 1:1:1 weight ratio. Gaseous products were analyzed using an HP 5840 gas chromatograph. Liquid products were distilled using a modified ASTM D-1160 apparatus.

Liquid yields obtained from the distillate and bottoms runs were subtracted from the distillate, bottoms and coal runs to provide estimates of the net liquid yields directly attributable to the coals. This method of estimating net coal liquid yields has been successfully used to predict larger-scale SRC-I pilot plant yield data.

EXAMPLE 1

A slurry of 33 wt % Wyodak coal and 67 wt % distillate was liquefied for 1.5 hours at 850° F. and 2500 psi equivalent hydrogen pressure. The coal had the following chemical composition on a dry basis: 67.7 wt % C, 5.2 wt % H, 0.7 wt % N, 2.0 wt % S, 14.1 wt % O, and 10.3 wt % Ash. The solvent was a Wyodak coal-derived distillate, i.e., distillable liquid boiling between 500° F. and 900° F. The product slate obtained was:

| Product | Wt % of Dry Coal |
|---|---|
| $C_4$-500° F. | 22.7 |
| 500° F.–800° F. | 9.4 |
| 800° F.+ | 37.1 |
| Unconverted Coal | 5.3 |
| Total $C_4$-800° F. Yield | 32.1 |

EXAMPLE 2

The coal liquefaction process of Example 1 was repeated, except that the recycle solvent was a 1:1 blend of Wyodak coal-derived distillate and Wyodak coal-derived bottoms which had been mildly hydrogenated as described in the experimental procedure. The hydrotreated bottoms portion of the solvent contained 6.37 percent by weight hydrogen, boiled above 800° F. to 1000° F. and had the following composition:

| Component | Weight Percent |
|---|---|
| Oils | 37.8 |
| Asphaltenes | 42.1 |
| Preasphaltenes | 18.6 |
| Insoluble Organic Material | 1.5 |

The product slate obtained from the liquefaction process was:

| Product | Wt % of Dry Coal |
|---|---|
| $C_4$-500° F. | 23.2 |
| 500° F.–800° F. | 37.1 |
| 800° F.+ | 11.7 |
| Unconverted Coal | 3.8 |
| Total $C_4$-800° F. Yield | 60.3 |

A comparison of the data from Examples 1 and 2 demonstrates that in the absence of any hydrotreated vacuum still bottoms, i.e., using 100% distillate as the solvent, the amount of high boiling fuel oils, i.e., 800° F.+, is maximized, whereas in the presence of a solvent containing about 50 weight percent hydrotreated bottoms according to the present invention, about a 100 percent increase of low boiling distillates, i.e., $C_4$–800° F., is obtained.

EXAMPLE 3

A slurry of 33 wt % Wyodak coal and about 67 wt % solvent was liquefied for 1.5 hours at 825° F. and 2500 psi equivalent hydrogen pressure. The coal had the following chemical content on a dry basis: 70.5 wt % C, 5.2 wt % H, 1.0 wt % N, 0.6 wt % S, 13.9 wt % O, and 8.8 wt % Ash. The solvent was a 1:1 blend of distillate and bottoms obtained from noncatalytic liquefaction of Wyodak coal as described in the experimental section. The unhydrotreated bottoms fraction of the solvent contained 6.13 percent by weight hydrogen, boiled above 800° F. to 1000° F. and had the following composition:

| Component | Weight Percent |
|---|---|
| Oil | 23.0 |
| Asphaltenes | 31.2 |
| Preasphaltenes | 45.1 |
| Insoluble Organic Material | 0.7 |

The product slate obtained from the liquefaction process was:

| Product | WT % of Dry Coal |
|---|---|
| $C_4$-500° F. | 11.0 |
| 500° F.-800° F. | 17.4 |
| 800° F.+ | 22.7 |
| Unconverted Coal | 20.8 |
| Total $C_4$-800° F. Yield | 28.4 |

EXAMPLE 4

The liquefaction process of Example 3 was repeated, except that the solvent of Example 2 was used. The product slate obtained was:

| Product | Wt % of Dry Coal |
|---|---|
| $C_4$-500° F. | 30.4 |
| 500° F.-800° F. | 24.4 |
| 800° F.+ | 16.8 |
| Unconverted Coal | 2.8 |
| Total $C_4$-800° F. Yield | 54.8 |

A comparison of the data from Examples 3 and 4 demonstrates that the yield of $C_4$–800° F. product from subbituminous coal is increased, i.e., from 28.4 to 54.8 percent, by mild hydrogenation of the unhydrogenated bottoms portion of the solvent.

EXAMPLE 5

The liquefaction process of Example 3 was repeated except that the solvent was a 1:1 blend of distillate and bottoms which had been severely hydrogenated as described in the experimental procedure. The hydrotreated bottoms portion of the solvent contained 6.61 percent by weight hydrogen, boiled above 800° F. to 1000° F. and had the following composition:

| Component | Weight Percent |
|---|---|
| Oils | 59.6 |
| Asphaltenes | 36.8 |
| Preasphaltenes | 2.2 |
| Insoluble Organic Materials | 1.4 |

The product slate obtained was:

| Product | Wt % of Dry Coal |
|---|---|
| $C_4$-500° F. | 23.0 |
| 500° F.-800° F. | 17.9 |
| 800° F.+ | 33.3 |
| Unconverted Coal | 7.4 |
| Total $C_4$-800° F. Yield | 40.9 |

A comparison of the data from Examples 3, 4 and 5 demonstrates that there is an optimum in the amount of hydrogen which should be added to the bottoms produced from a subbituminous coal and used as a recycle solvent component. The addition of a small amount of hydrogen to unhydrogenated bottoms significantly improves the hydrogen donor quality of the solvent. Excessive hydrogenation degrades the hydrogen donor quality of the solvent. The difference in hydrogen content between underhydrogenated and overhydrogenated bottoms is small.

EXAMPLE 6

A slurry of 33 wt % Kentucky 9/14 coal and 67 wt % solvent was liquefied for 1.5 hours at 825° F. and 2500 psi equivalent hydrogen pressure. The coal had the following chemical content on a dry basis: 72.2 wt % C, 7.1 wt % H, 1.2 wt % N, 4.1 wt % S, 4.6 wt % O, and 10.8 wt % Ash. The solvent was a 1:1 blend of Kentucky 9/14 coal-derived distillate and unhydrotreated Kentucky 9/14 coal-derived bottoms. The unhydrotreated bottoms contained 5.35 percent by weight hydrogen, boiled above 800° F. to 1000° F. and had the following composition:

| Component | Weight Percent |
|---|---|
| Oils | 6.0 |
| Asphaltenes | 60.3 |
| Preasphaltenes | 32.7 |
| Insoluble Organic Material | 1.0 |

The product slate obtained was:

| Product | Wt % of Dry Coal |
|---|---|
| $C_4$-500° F. | 20.1 |
| 500° F.-800° F. | 33.4 |
| 800° F.+ | 8.4 |
| Unconverted Coal | 3.7 |
| Total $C_4$-800° F. Yield | 53.5 |

EXAMPLE 7

The liquefaction process of Example 6 was repeated except that the bottoms were mildly hydrogenated as described in the experimental procedure. The mildly hydrotreated bottoms contained 6.4 percent by weight hydrogen, boiled above 800° F. to 1000° F. and had the following composition:

| Component | Wt % of Dry Coal |
|---|---|
| Oils | 52.3 |
| Asphaltenes | 26.8 |
| Preasphaltenes | 20.2 |
| Insoluble Organic Material | 0.7 |

The product slate obtained was:

| Product | Wt % of Dry Coal |
|---|---|
| $C_4$-500° F. | 30.8 |
| 500° F.-800° F. | 34.6 |
| 800° F.+ | 7.3 |
| Unconverted Coal | 4.8 |
| Total $C_4$-800° F. Yield | 65.4 |

A comparison of the data from Examples 5 and 6 demonstrates that the yield of $C_4$–800° F. produced from bituminous coal is increased, i.e., from 53.5 to 65.4 percent, by mild hydrogenation of the unhydrogenated bottoms portion of the solvent.

EXAMPLE 8

The liquefaction process of Example 6 was repeated except that the bottoms were severely hydrogenated as described in the experimental procedure. The severely hydrogenated bottoms contained 6.65 percent by weight hydrogen, boiled above 800° F. to 1000° F. and had the following composition:

| Component | Weight Percent |
|---|---|
| Oils | 45.8 |
| Asphaltenes | 48.7 |
| Preasphaltenes | 3.4 |
| Insoluble Organic Matter | 2.1 |

The product slate obtained was:

| Product | Wt % of Dry Coal |
|---|---|
| $C_4$-500° F. | 23.3 |
| 500° F.-800° F. | 35.6 |
| 800° F.+ | 15.2 |
| Unconverted Coal | 11.0 |
| Total $C_4$-800° F. Yield | 58.9 |

Comparison of the results presented in Examples 6, 7 and 8 demonstrates that similar to the results obtained for a subbituminous coal shown in Examples 3, 4 and 5, there is an optimum in the amount of hydrogen which should be added to bottoms produced from a bituminous coal and used as a recycle solvent component.

Although the foregoing invention has been described in some detail by way of illustration and example for purposes of clarity of understanding, it will be obvious that certain changes and modifications may be practiced within the scope of the invention, as limited only by the scope of the appended claims.

What is claimed is:

1. In a coal liquefaction process wherein a slurry of feed coal and a solvent are introduced into a coal liquefaction zone wherein coal dissolution and hydrogen transfer to the coal fragments formed in dissolution are accomplished by heating the slurry in the presence of molecular hydrogen, the improvement comprising using as a hydrogen donor material in the solvent, coal-derived, pyridine-soluble, bottoms consisting essentially of oils, asphaltenes and preasphaltenes boiling above about 800° F. to about 1000° F., containing no more than about 50 weight percent benzene-insoluble material, all of which bottoms have been hydrotreated in a hydrotreater under mild conditions sufficient to add to said bottoms a controlled amount of hydrogen in the range of from about 0.05 to about 2.0 weight percent.

2. A method according to claim 1 wherein said process further comprises a solid separation stage prior to said hydrotreating.

3. A method according to claim 1 further comprising a solid separation step following said hydrotreating.

4. A method as in claim 1 wherein said bottoms have been hydrotreated over a catalyst for about 0.1 to about 3.0 hours at a temperature between about 600° F. and about 800° F. and a hydrogen partial pressure of between about 1000 to about 4000 psi.

5. A method as in claim 1 wherein said temperature is between about 650° F. to about 750° F.

6. A method as in claim 5 wherein said temperature is between about 680° F. to about 720° F.

7. A method as in claim 4 wherein said hydrogen partial pressure is between about 1500 to about 3000 psi.

8. A method as in claim 7 wherein said hydrogen partial pressure is between about 1800 to about 2500 psi.

9. The process of claim 1 in which the coal liquefaction solvent also contains distillates in an amount of from about 0 weight percent to the balance of the solvent, the amounts of hydrogenated bottoms and distillates being selected to maximize yields of liquefaction products ranging from primarily low boiling distillates to primarily high boiling fuel oils.

10. The improvement according to claim 9 wherein said solvent comprises from about 20 to about 100 wt % of said bottoms to maximize low boiling distillate yield.

11. The improvement according to claim 10 wherein the hydrotreated pyridine-soluble bottoms are present from about 30 to about 70 wt %.

12. The improvement according to claim 11 wherein said bottoms are present from about 40 to about 60 wt %.

13. The improvement according to claim 9 wherein said solvent comprises less than about 40 wt % hydrotreated pyridine-soluble bottoms whereby high boiling fuel oil yield is maximized.

14. The improvement according to claim 13 wherein (a) is less than about 20 wt % of said solvent.

15. The improvement according to claim 14 wherein (a) is less than about 10 wt % of said solvent.

* * * * *